United States Patent [19]

Bond

[11] Patent Number: 4,658,916

[45] Date of Patent: Apr. 21, 1987

[54] METHOD AND APPARATUS FOR HYDROCARBON RECOVERY

[76] Inventor: Les Bond, P.O. Box 624, Neosho, Mo. 64850

[21] Appl. No.: 775,996

[22] Filed: Sep. 13, 1985

[51] Int. Cl.[4] ..... E21B 7/08; E21B 17/20; E21B 17/22

[52] U.S. Cl. ..... 175/81; 175/323; 138/130

[58] Field of Search ..... 175/79, 40, 61, 62, 175/73–78, 80–83, 323, 232, 48; 138/129, 130

[56] References Cited

U.S. PATENT DOCUMENTS

| | | | |
|---|---|---|---|
| 1,706,072 | 3/1929 | Rieger | 175/232 |
| 1,891,330 | 12/1932 | Compte et al. | 175/48 |
| 2,198,016 | 4/1940 | Rogers et al. | 175/82 |
| 2,344,277 | 3/1944 | Zublin | 175/61 |
| 2,608,384 | 8/1952 | Alexander | 175/40 |
| 2,825,364 | 3/1958 | Cullen et al. | 138/130 |
| 3,118,508 | 1/1964 | Friedman et al. | 175/79 |
| 4,007,797 | 2/1977 | Jeter | 175/81 |
| 4,307,780 | 12/1981 | Curington | 175/81 |

FOREIGN PATENT DOCUMENTS

| | | | |
|---|---|---|---|
| 0697857 | 11/1964 | Canada | 175/82 |

*Primary Examiner*—Stephen J. Novosad
*Assistant Examiner*—Bruce M. Kisliuk
*Attorney, Agent, or Firm*—Laney, Dougherty, Hessin & Beavers

[57] ABSTRACT

Apparatus for radial drilling into selected formations adjacent an earth borehole, the apparatus consisting of concentric, counterwound spring shafts operating in conjunction with a rotary drive source and a guide housing positionable to direct the rotating bendable shaft down and outward in a radial direction. The apparatus includes bit weight limiting means and guide housing locking means which enable effective radial drilling operation in any selected angular and/or radial directions to greatly multiply and enlarge the producing formation interface.

21 Claims, 15 Drawing Figures

METHOD AND APPARATUS FOR HYDROCARBON RECOVERY

BACKGROUND OF THE INVENTION

1. Field of the Invention

The invention relates to method and apparatus for achieving increased hydrocarbon recovery by enlarging the effective recovery zone along a generally horizontal axis relative to the primary borehole. The apparatus consists of a flexible drill shaft and downhole assembly for controlling position and direction of lateral hole formation relative to producing hydrocarbon zones. The particular flexible shaft may find diverse utility in the related geophysical and mining fields.

2. Description of the Prior Art

The prior art has included a number of attempts at horizontal drilling wherein assemblies function from a primary borehole in an attempt to drill laterally therefrom. Such prior attempts have been marginally successful at best since no reliable, ongoing practice has evolved while the benefits to be derived are fairly evident. A U.S. Pat. No. 2,198,016 in the name of Rogers et al provides a teaching that utilizes a combination of a helical coil contained within a wire sheath and functioning within a series of stabilizing rings. This teaching utilizes but a single coil shaft portion and must rely on sheathing and encircling stablizing rings for further reliability in producing hole.

U.S. Pat. No. 2,441,881 in the name of Hays also attempted construction of a horizontal drill shaft using a linear series of coil springs as stabilized internally by down-flowing fluid pressure. The following patents also each disclosed a combination of force transmission elements adapted for deviation or lateral direction drilling from a generally vertical borehole:

Granville, U.S. Pat. No. 1,367,042
Prindle, U.S. Pat. No. 1,595,922
McCune, U.S. Pat. No. 2,726,847
Bull, U.S. Pat. No. 3,958,649

Each of the above patents relates to some form of hybrid-type linkage device in a serial connection that may be rotationally driven and controllably positioned for lateral directional drilling procedure. The patent to Granville discloses yet another coil spring combination wherein a helically wound, tightly coiled element is operated in combination with a central chain linkage that is universally interconnected between opposite ends of the drill shaft. None of the prior art discloses the use of a combination of oppositely wound coil shafts that are maintained in flush disposition both radially and along the length of the drill shaft thereby to provide reliable, straight drive rotational force once redirected.

SUMMARY OF THE INVENTION

The present invention relates to improvements in flexible drill shafts and methods of increasing hydrocarbon recovery from wells. The invention utilizes a flexible drill shaft that is operable from the primary, vertical borehole to be directionally aligned along a generally horizontal path for a significant distance of lateral drilling thereby to enlarge formation contact area. The drill shaft of the present invention consists of a plurality of oppositely wound, concentric helical coils of suitable steel stock. Each helical coil is connected between a drive coupling member and the drill bit assembly in tightly wound manner wherein adjacent edge surfaces of coils are flush, and the concentricity of the plural helical coils is such that the respective members are in contacting relationship. A flexible fluid conduit is then interconnected axially through the drill shaft between drive coupling and drill bit.

The flexible drill shaft is utilized with a positioning and control assembly which consists of an upper drive shaft receiving rotational input as connected through a bit weight limiter mechanism to a drill guide housing and lower most packer assembly. The drill guide housing includes a Jay locking device in the upper portion for retaining the drill guide housing during movements in the borehole and positioning of the packer; thereupon, the packer may be set and the Jay lock freed by a predetermined number of revolutions of the drive coupling to apply downward pressure on the flexible drill shaft. The bit weight limiter assembly is pressure responsive to provide an uphole indication when the weight on the drill bit exceeds a predetermined amount.

Therefore, it is an object of the present invention to provide a method and apparatus for increasing the amount of hydrocarbon recovered from a reservoir.

It is also an object of the present invention to provide a flexible drill shaft that is capable of applying considerable forward thrust while still maintaining straight directional drilling capabilities.

It is yet another object of the present invention to provide a method and apparatus for greatly increasing the release interface of a producing hydrocarbon zone.

It is still another object of the present invention to provide apparatus that can be accurately placed in a borehole adjacent a selected formation and accurately controlled to drill laterally therefrom.

Finally, it is an object of the present invention to provide a downhole lateral drilling assembly having the capability of accurately drilling at a selected angle from the borehole while maintaining precise control over the applied bit weight up to a predetermined limit.

Other objects and advantages of the invention will be evident from the following detailed description when read in conjunction with the accompanying drawings which illustrate the invention.

DETAILED DESCRIPTION OF THE INVENTION

Figure 1:
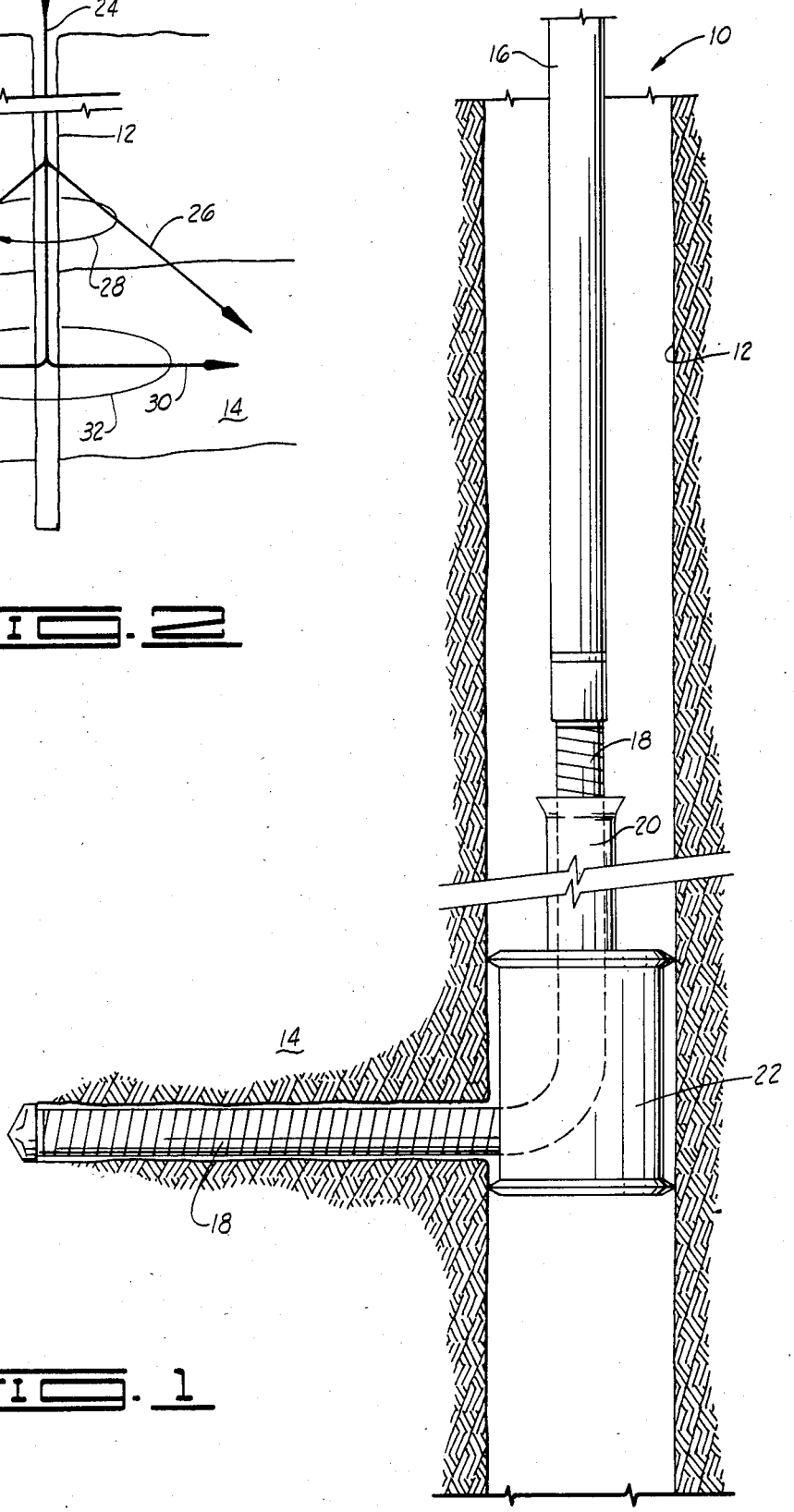
FIG. 1 is an idealized view in elevation of the basic structure and operation of the present invention.

FIG. 1 illustrates the lateral drilling scheme of the invention in idealized manner wherein a lateral drilling apparatus 10 is anchored in a previously formed borehole 12 to perform lateral penetration into a selected stratum or formation 14. Rotary drilling force may be supplied by means of such as a conventional drill shaft 16, i.e. an interconnected series of drill pipe sections. The drill shaft 16 is secured in positive affixure to a flexible drill shaft 18 that is then directed through a guide way 20 and diverter assembly 22 to bore at a designated angle into the formation 14. The guide member 20 may be of a selected length to accommodate the length of drill shaft 18 and the amount which must be reciprocally movable along the vertical axis of borehole 12. The diverter assembly 22 may include integral guide, diverter and packer apparatus for operative positioning at a designated level in the borehole 12, as will be further discussed below.

Figure 2:
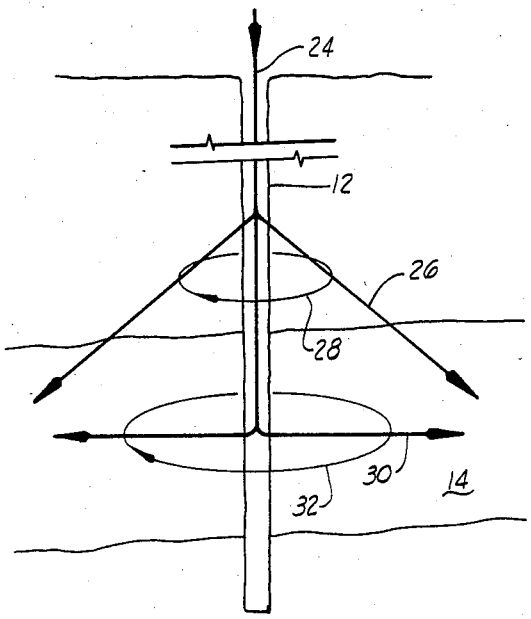
FIG. 2 is a schematic illustration of possible drilling modes relative to an earth borehole.

The lateral drilling apparatus 10 may be utilized variously to extend or enlarge the interface with hydrocarbon producing zones as illustrated generally in FIG. 2. Thus, the primary borehole 12 may be diverted for lateral drilling by flexible drill shaft 18 at any of selected angles relative to vertical axis 24 and at any azimuth therearound. The diverter assembly 22 (FIG. 1) can be readily adapted to provide whatever vertical angle direction and suitable stop and indexing mechanism to set the angle of azimuth or direction of drilling. Thus, as shown in FIG. 2, the flexible drill shaft 18 may be directed at a 45° angle such as at arrow 26 and it may be directed in any one or more selected azimuth bores about the circle 28. In like manner, right angle radial drilling may extend along arrow 30 at any selected direction of azimuth around the circumfery 32. Selection of radial drilling angle and azimuth will depend upon the exigencies of the particular drilling operation relative to the producing zone.

The benefits of radial drilling in order to increase fluid flow (either into or out of penetration) is fairly obvious as production of oil, or gas, or injection of drive fluid could benefit significantly from drilling out laterally within a producing formation. In addition, still further possibilities exist wherein a flexible drill shaft of porous nature may be inserted laterally in a formation and then separated from the drive system to remain in situ as a tubular member defining a complete production interface flowing to the primary borehole. This member would constitute a fluid/solid separator for improving both production rate and recovery efficiency from the hydrocarbon zone. This technique will be especially applicable for use in the soft sands of the Gulf of Mexico, California, Alaska and other such producing areas wherein the large marjority of United States hydrocarbon production occurs.

Figure 3:
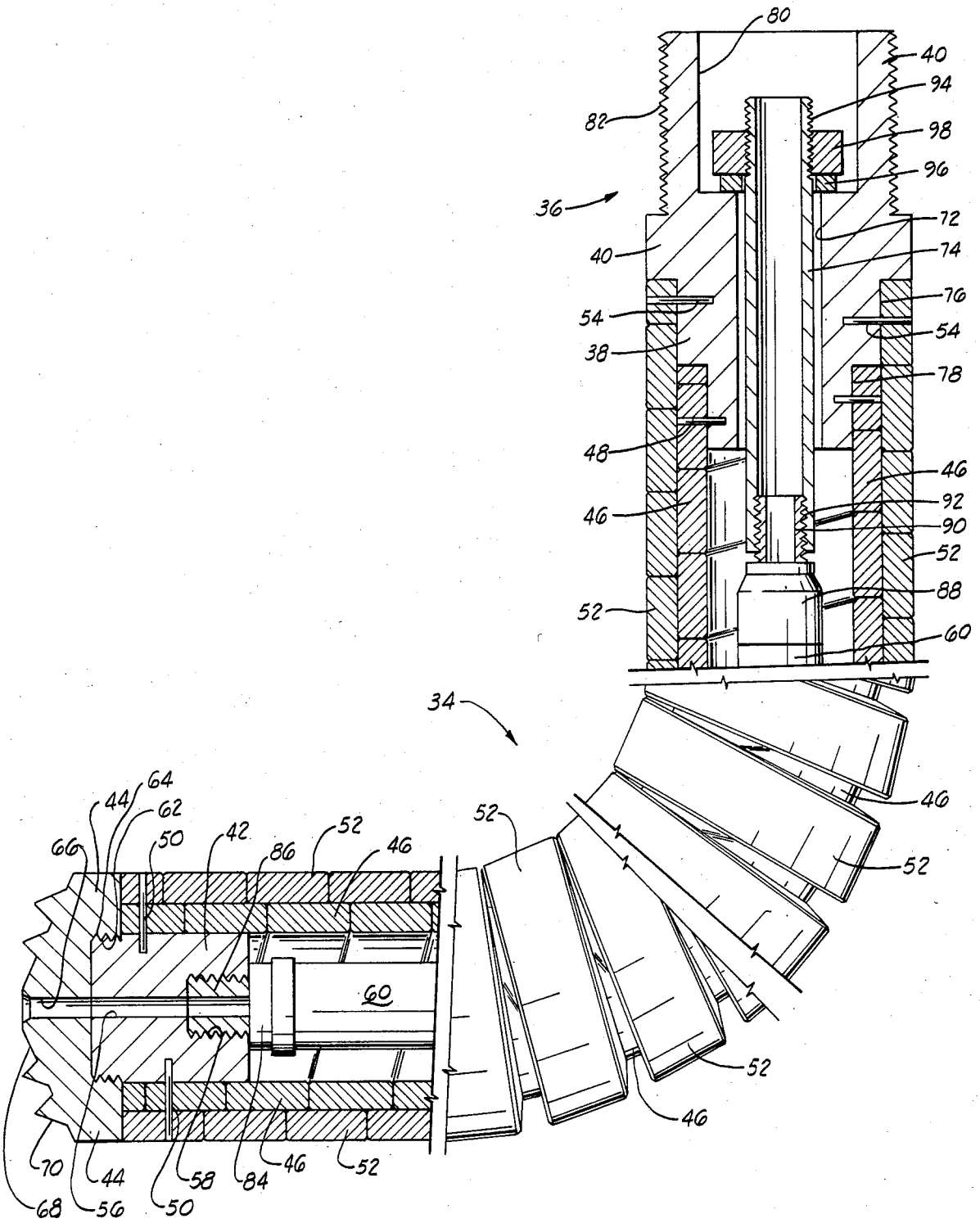
FIG. 3 is a segmental view in elevation with parts shown in section of a flexible drill shaft constructed in accordance with the present invention.

FIG. 3 illustrates one form of flexible drill shaft 34 that may be utilized in the present invention. The shaft 34 includes a drive coupling 36 that consists of an inner mandrel portion 38 and an outer sleeve portion 40. The opposite end of shaft 34 terminates with a spindle 42 disposed in threaded affixure to a drill bit 44. The flexible shaft itself consists of an inner, helically wound coil 46 as maintained in a tight spiral as affixed by pin 48 connection between mandrel portion 38 and pin 50 at spindle 42. An outer, helically wound coil 52 of flat steel stock is oppositely wound from inner coil 46 and disposed flush thereto as it is connected by respective pins 54 and 50 between mandrel portion 38 and spindle 42.

The inner coil 46 and outer coil 52 are disposed in flush, contacting relationship and are oppositely wound so that with any twisting moment in either direction, they work against each other to maintain contact and longitudinal rigidity. In the case of a greater number of coils, such as a four-layer coil arrangement, the alternate coils are oppositely wound to effect the same conditions of effective shaft continuity, as will be further described below. The coils may be formed from such as SAE 6150 steel stock or other comparable rectangular steel rod having a width-to-thickness ratio on the order of three-to-one. For example, a coil has worked to good advantage when formed of No. 1065 steel while having cross-sectional dimensions of 0.375 inches width by 0.125 inches thickness, each of the four corners being slightly broken, e.g. a radius of about 0.03125 inches. It has been found empirically that the slight radius break on each corner of the coil stock is extremely important to maintain even bending disposition of the coil sections during flexure under torque force. Actually, the type of steel and overall size of coil cross-section will vary with the exigencies of the particular application, and materials may be selected from a large number of types.

Also, it has been found advantageous to vary the coil stock thicknesses by using slightly larger thickness stock for more outer situated coils. This is particularly desirable in flexible drill shafts having a greater number of concentric coils, as will be further described below.

The spindle 42, a cylindrical structure, is formed with an axial bore 56 for drilling fluid passage and a threaded counterbore 58 is adapted to receive the drilling fluid conduit 60. The outer end of spindle 42 then includes threads 62 for engagement with a threaded counterbore 64 of drill bit 44. The drill bit 44 also includes an axial drilling fluid bore 66 and the cutting face 68 includes a predetermined tooth or cutting edge structure, as will be further described below. Cutting face 68 is a conventional type having a plurality of cutting points 70 disposed therearound and it may include hardfacing, diamond emplacement or the like.

The drive coupling 36 is formed to include an axial bore 72 of relatively wide diameter for receiving a coupling tube 74 upward therethrough in final assembly of the drill shaft, as will be further described. The mandrel portion 38 includes a series of annular shoulders 76 and 78, one for each concentric coil, and the collar portion 40 includes a wide diameter axial counterbore 80 to enable securing of coupling rod 74. An outer threaded circumfery 82 is adapted for secure affixure to whatever the associated rotational drive source.

The flexible conduit 60 consists of an armored, high pressure hydraulic-type conduit having a hose coupling 84 on the lower end with a threaded male portion 86 for fluid-tight insertion within threaded counterbore 58. At the upper end, hose or conduit 60 includes a high pressure coupling 88 and threaded male insert 90 for affixure within a threaded inner bore 92 of coupling tube 74. The upper end of coupling tube 74, having an outer diameter threaded portion 94, is adapted to be captured and threadedly retained by means of a washer 96 and nut 98 within the bore 80.

The particular structure as shown in FIG. 3 is specifically adapted to enable accurate and effective assembly of the various components of the flexible drill shaft 34. The design enables assembly of all components in tight and efficient manner, an essential factor in such flexural shaft wherein oppositely wound, concentric coils must maintain predetermined spacing relationship throughout all flexural attitudes. Thus, in assembly, the insert 86 of conduit 60 is threadedly secured in bore 58 of spindle 42. The coils 46 and 52 are first formed with essentially accurate measurements as regards the bit end and the coupling end, and the bit end of the coils are then positioned over conduit 60 onto spindle 42 and pins 50 are accurately placed.

The drive coupling 36 can then be inserted in the opposite end of coils 46 and 52 and aligned for placement of the respective pins 48 and 54 around the respective annular shoulders 78 and 76. Completion of the assembly is then effected by inserted coupling tube 74 for threaded capture of male insert 90 of conduit 60, whereupon placement and tightening of nut 98 brings the entire assembly into tight, secure inner engagement. It is important too that a lesser number of pins 50 be used at the bit end than the opposite end pins 48 and 54 thereby to influence the breakage point, it being desirable that any pin-shearing take place at the bit end so that maximum structure can be withdrawn from the hole for remedial measures.

Figure 4:
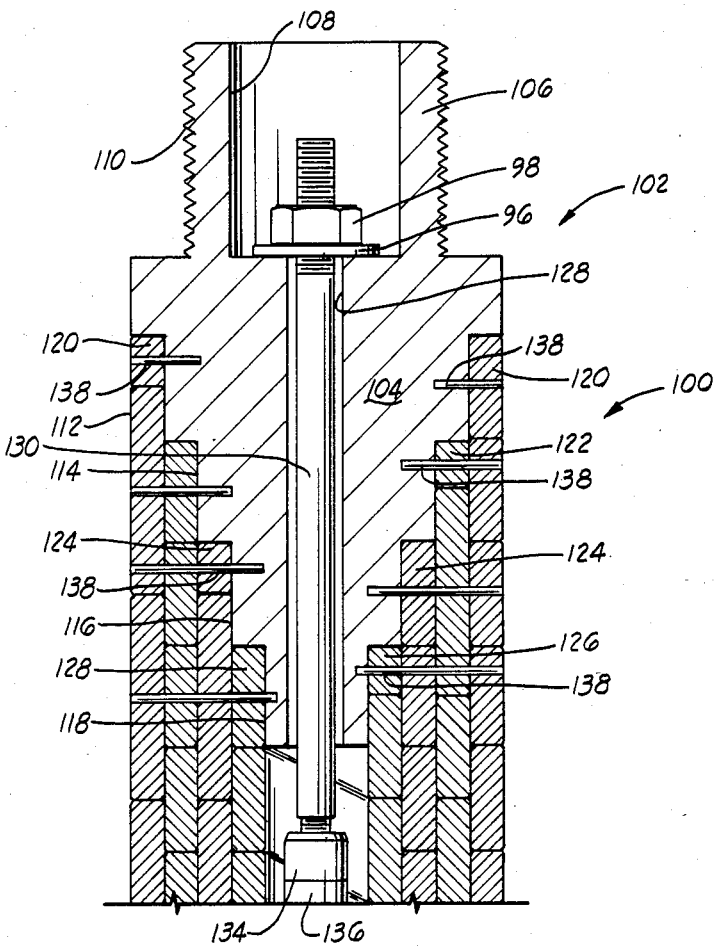
FIG. 4 is a view in section of the drive coupling end of a four coil flexible drive shaft constructed in accordance with the invention.

FIG. 4 illustrates a portion of a four-layer flexible drive shaft 100 showing the upper end, i.e. the four concentric, oppositely wound helical coils as they are secured to a drive coupling 102. Drive coupling 102 consists of a mandrel portion 104 and a coupling portion 106, the coupling portion 106 being formed with a wide diameter axial bore 108 and having threads 110 formed about the outer circumfery. The mandrel portion 104 is formed with four annular shoulders 112, 114, 116 and 118 for receiving affixure of the respective oppositely wound helical coils 120, 122, 124 and 126. The mandrel portion 104 includes an axial bore 128 which receives a coupling tube 130 therethrough. Coupling tube 130, similar to tube 74 of FIG. 3, receives threaded engagement of a threaded male insert 132 of hose coupling 134 as secured on a flexible fluid conduit 136. Conduit 136 consists of heavy duty, high pressure hydraulic-type hose and provides conduction of drilling fluid under pressure through the axial cavity of the flexible drive shaft 100. A plurality of pins 138 are located in selective spacing to secure each end portion of the respective helical coils 120–126. The opposite end of drill shaft 100 is not particularly shown but it would consist of structure including a spindle for bit engagement similar to that of FIG. 3 with the exception that four, oppositely wound layered coils would terminate on the spindle. Also, it is preferable that the helical coils be pinned to the spindle with less pins so that any shearing of pins will occur at the bit end.

In present practice, a four-coil flexible shaft 100 has been constructed and utilized in the field to good advantage. In this particular design, type 4150 steel bar stock was utilized in formation of the coil springs and the stock dimensions were varied in accordance with position in the layering in order to distribute the torque relatively evenly. Thus, with all coil stock being three-eighths inch in width, the thicknesses were varied from the inner most coil at one-eighth inch; the second coil at 0.160 inch thickness; the third coil at 0.21 inch thickness; and, the outer coil at one-quarter (0.25) inch thickness. The flexible drill shaft formed to these specifications exhibited excellent operational characteristics and the drill shaft had an overall diameter of slightly less than two inches. The shaft had size and handling capability that functioned well in tight, drilling deviation situations.

Figure 5A:
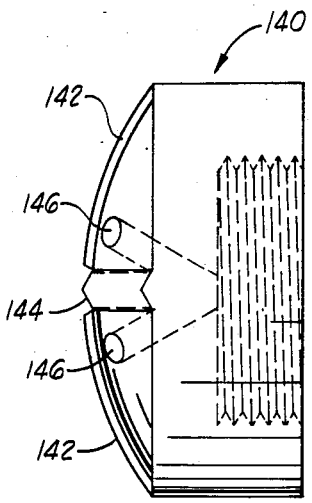
FIG. 5A is a side view of a drill bit constructed in accordance with the present invention.
Figure 5B:
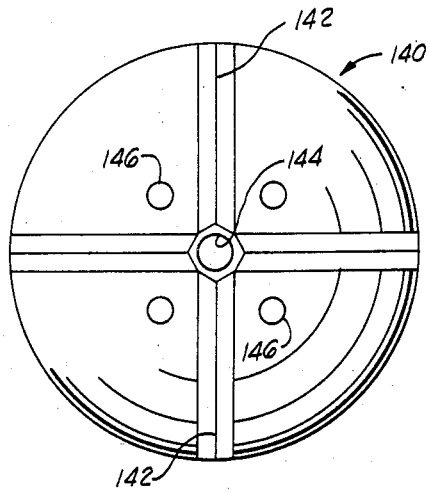
FIG. 5B is a plan view of the drill bit of FIG. 5A.

The flexible drilling teachings of the present invention can utilize various types of drill bit. Conventional considerations largely dictate the shape and type of face of the drill bit. FIG. 3 illustrates one form of drill bit having a plurality of cutting points 70 protruding from the face 68. FIGS. 5A and 5B illustrate yet another form of drill bit 140 wherein quadrature arrayed cutting edges 142 are formed thereon. Axially fed drilling fluid may be released from a central port 144 as well as from a plurality of radially positioned ports 146, also in quadrature array. The cutting edges 142 may be hardened or reinforced with cutting materials in conventional manner.

Figure 6:
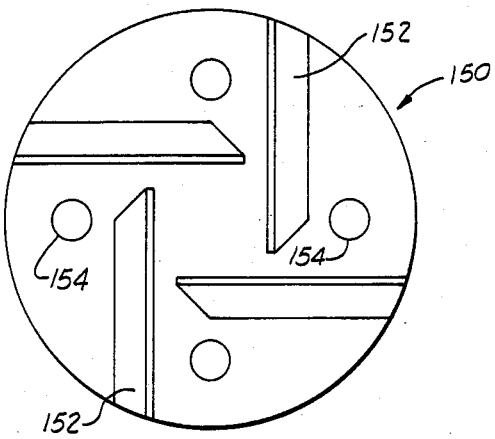
FIG. 6 is a plan view of an alternative form of drill bit.
Figure 7:
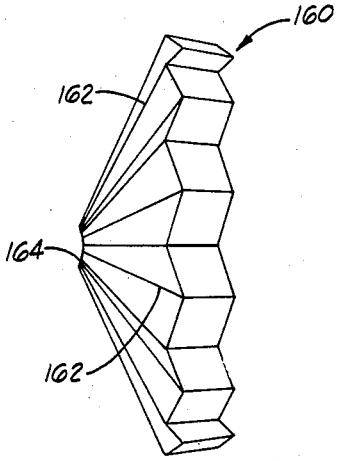
FIG. 7 is a side view of yet another form of drill bit for use in the present invention.

FIG. 6 shows still another form of drill bit face 150 which includes four normally arrayed cutting edges 152 with interstitially disposed drilling fluid ports 154. FIG. 7 illustrates a conventional star drill-type bit face 160 which includes the radial cutting edges 162 and central drilling fluid orifice 164. The choice of drill bits for use with the flexible drill shaft would be dictated by the same basic concerns as choice of bits for vertical hole drilling, i.e. the hardness and attendant considerations of the formation.

Figure 8:
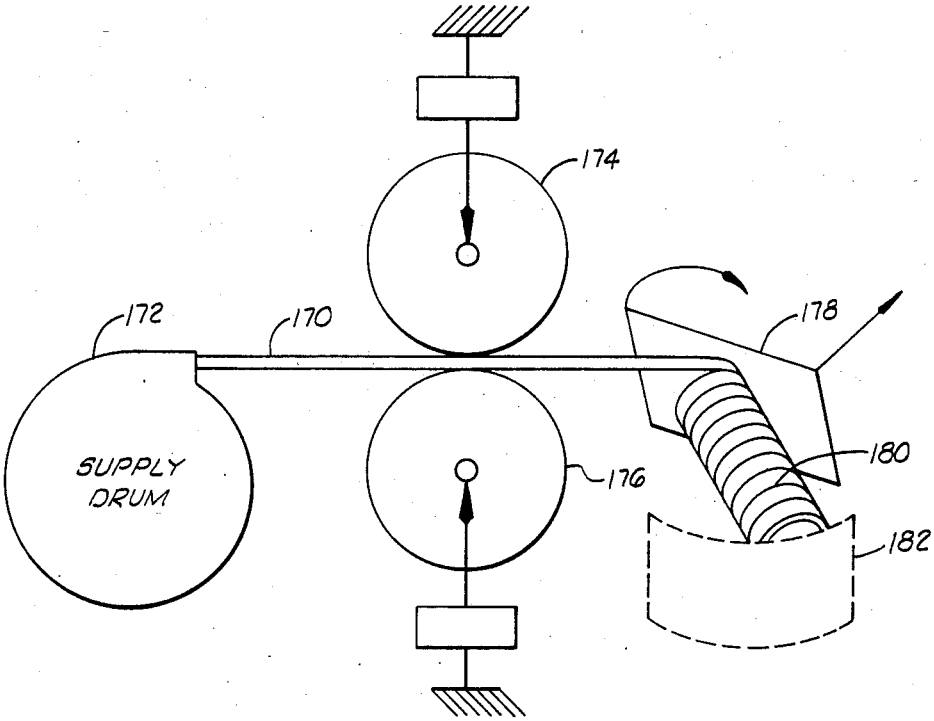
FIG. 8 is a schematic illustration showing the manner of forming helically coiled steel stock for use in assembly of the flexible drillshaft of the present invention.

FIG. 8 illustrates the manner in which the individual helical coils are formed for assembly into the flexible drill shaft. Thus, the bar stock steel 170 of selected width and thickness dimension is supplied from a drum or other supply source 172 through steel drive rollers 174 and 176. Passage of the bar stock 170 is rigidly guided through drive rollers 174 and 176 to abut onto a deflection plate 178 at a prescribed angle thereby to define the degree of bending and therefore the size of helically wound flexible coil 180 that is finally formed. As the coil 180 is formed in considerbale length, it may be deflected and coiled into a repository show generally by dash lines 182. The deflector 178 is readily adjustable to set the angle of deflection of the bar stock 170 so that coil 180 may be formed uniformly within a wide range of size specifications.

Figure 9A:
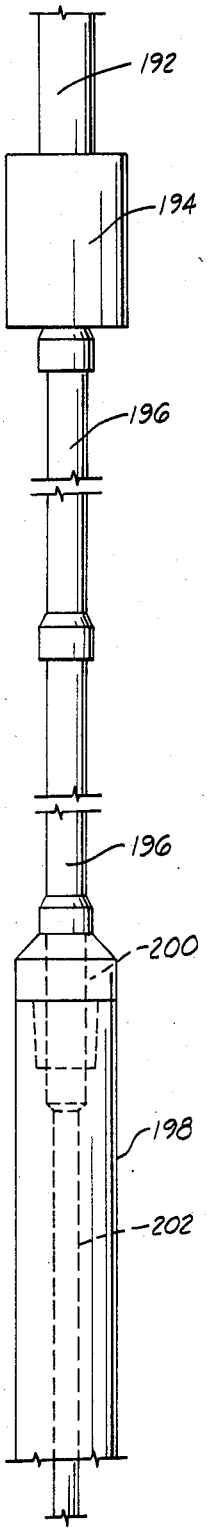
FIGS. 9A and 9B illustrate a lateral drilling assembly constructed in accordance with the present invention.
Figure 9B:
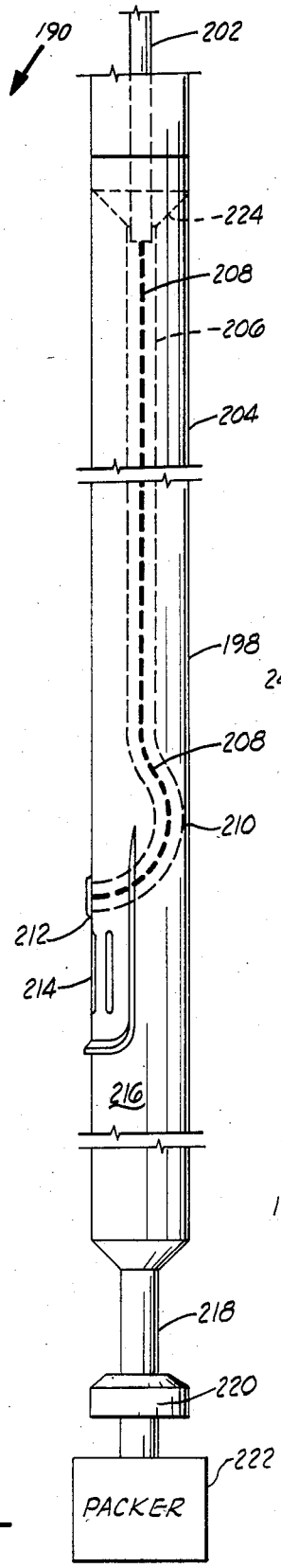

FIGS. 9A and 9B illustrate respective upper and lower portions of a radial drilling assembly 190 that may be utilized for effective radial drilling using a flexible shaft constructed in accordance with the present invention. Assembly 190 receives drill stem rotation via an upper drive shaft 192 working in conjunction with a weight limiter assembly 194 to convey rotation via extended drill pipe interconnection 196. The drill pipe 196 then extends downward into connection with a drill guide housing or sub 198 which includes a Jay locking device 200 in the upper portion, and which transmits rotation therethrough by means of a rotary shaft 202. A lower section 204 of guide sub 198 then includes a concentric guide tube 206 through which the flexible drill shaft is directed.

The flexible drill shaft 208 is shown in dash-line but may be a multi-coil shaft of oppositely wound plural layers, such as previously shown in FIGS. 3 and 4. The rotary shaft 202 is tightly connected in threaded engagement to such as the coupling member 102 (FIG. 4) to secure and drive drill shaft 208 rotatably down through guide tube 206. Guide tube 206 is then directed through an angular bend 210 for outward release through a drill hole 212 toward a selected earth formation. A plurality of open slots 204 are provided immediately below drill hole 212 in communication with an internal volume 216 of lower section 204 that is sufficient to retain a generally predetermined portion of drill cuttings. That is, the volume of 216 should be sufficiently large to accommodate the expected amount of cuttings displaced by a flexible drill shaft of a predetermined number of feet. The lower sections 204 may be varied and substitutable to provide differing shaft angles of emergence at drill hole 212.

The lower end of guide sub 198 then includes a pipe section 218 and Jay lock retaining device 220 in interconnection to a selected packer 222. The packer 222 may be any of the well-known types that would be compatible with the overall structure, and packer 222 serves to anchor and maintain the radial drilling assembly 190 in position in the borehole during a radial drilling operation. The Jay lock retainer 220 may be effective in providing azimuth guide in positioning the radial drilling assembly 190 during initial placement operations in the borehole as well as in actuating the packer 222 in well-known manner.

The overall length of the radial drilling assembly 190 will vary in accordance with the space requirements of the drill shaft. Thus, if the flexible drill shaft 208 is thirty feet long, then the lower portion 204 of sub 198 must be on the order of 60 feet in order to accommodate the full movements of the drill shaft from totally contained to totally expended within an adjacent formation while also providing lower volume 216. In like manner, various sections of the rotary shaft 202 coupling must be of sufficient length to allow their rotation as well as movement of considerable axial lengths through the upper portion of sub 198.

The guide sub 198 is formed of a series of sections of five and one-half inch O.D. casing assembled to the requisite length. The lower section 204 of sub 198 is formed with an axial guide by means of a cone 224 welded within the casing and supporting a guide tube 206 axially therethrough. As shown in FIG. 9B, the lower portion of tube 206 is formed as a bent portion 210, and annular support structure may be included by welding radial struts or the like along the length of tube 206. In a presently constructed form, the tube 206 is formed from two and three-eighths inch tubing stock to easily accommodate a flexible drill shaft of approximately two inches outside diameter.

The upper end of guide sub 198 includes a locking device 200 that maintains the radial drill assembly 190 unitary during downhole maneuvering and positioning to place the drill hole 212 adjacent the desired formation, whereupon the packer 222 is actuated by trigger of the actuating device 220. For example, simple lifting or twisting action of the drill string can be utilized to set packer 222 in well-known manner. Once the packer 222 is set, it is necessary to free the rotating members for drilling operation and this is carried out by actuation of locking device 200.

Figure 10:
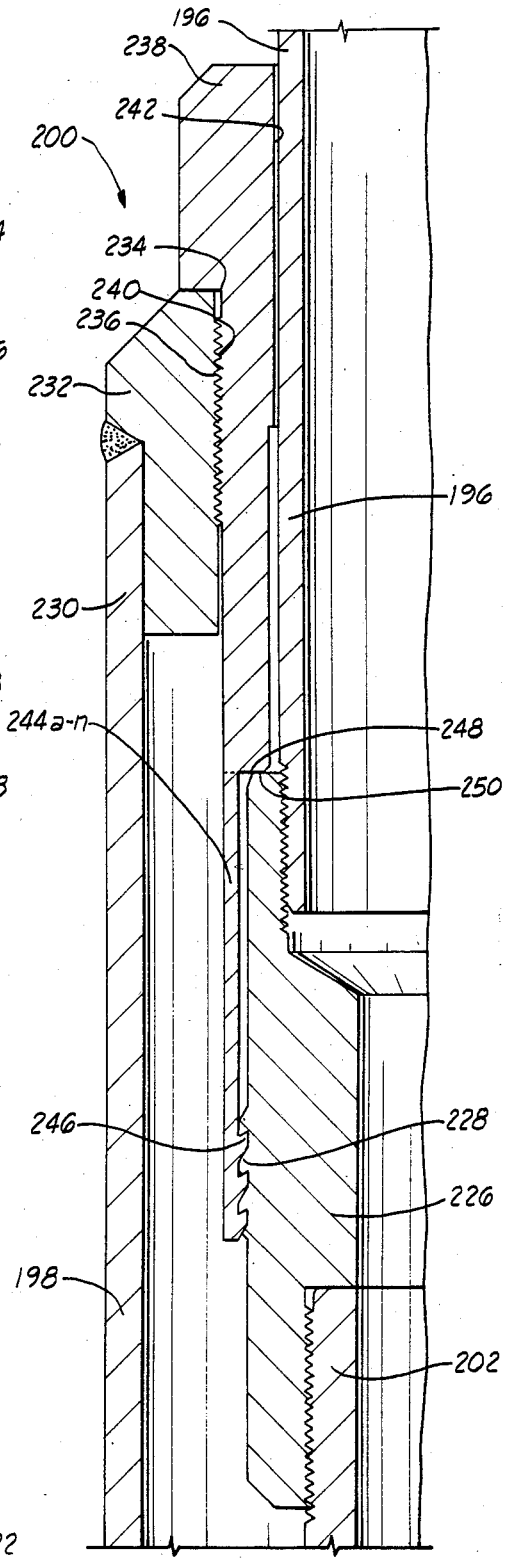
FIG. 10 is a partial view in section of a Jay locking assembly used in the assembly of FIG. 9A.

Referring to FIG. 10, the locking device 200 is shown in partial section as the rotary drill pipe 196 is joined to rotary shaft 202 by means of a drill collar 226 in conventional manner. A portion of the outer circumfery drill collar 226 includes formation of a plurality of threads 228, four such threads in the present construction. The casing 230 (upper section of guide sub 198) receives an end collar 232, as by welding, which has an axial bore 234 having threads 236. End cap 232 then receives threaded connection of a sleeve 238 having threads 240, sleeve 238 having an axial central bore 242 for rotationally receiving drill pipe 196 therethrough.

The lower portion of sleeve 238 is formed to extend a plurality of longitudinal spring fingers **224*a–n*, each of which has plural mating teeth 246 (in this case four) for engaging the drill collar threads 228. The spring fingers 244 may be varied in number in accordance with the casing and collar size and the amount of load to be supported; for example, fingers 244 would be a selected width and continuous around the circumfery separated only by minimal clearance. A lower annular shoulder 248 of sleeve 238 abuts with an upper annular shoulder 250 of drill collar 226 when the rotary member is in the upward position and finger teeth 246 are in locking engagement with threads 228**.

The locking device 200 functions to maintain the drill stem rigid with drill guide sub 198 during downhole positioning prior to drilling commencement. During positioning the teeth 246 of fingers **244*a–n* are securely engaged over threads 228 to hold drill collar 226 firmly abutted beneath shoulder 248 of locking sleeve 238. Once positioned, four revolutions of the drill stem frees threads 228 from teeth 246** and the rotary structure is free to move downward to carry out drilling activity.

Figure 11:
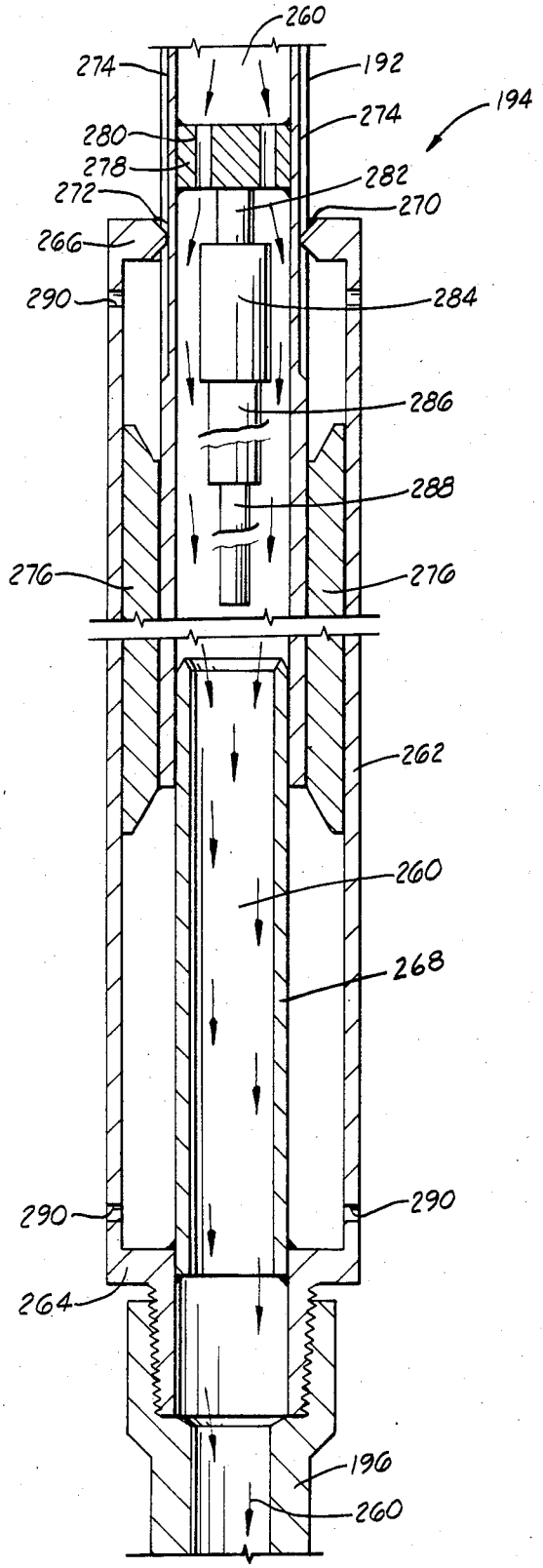
FIG. 11 is a schematic illustration of the bit weight limiting assembly used in the present invention.

FIG. 11 illustrates the essential structure of the weight limiter 194 interconnecting the upper drive shaft 192 with the drill pipe 196. The purpose of weight limiter 194 is to avoid placing excessive bit weight upon the flexible shaft during a radial drilling operation. Thus, weight limiter 194 provides hydraulic information at the drilling platform as the bit weight increases and, finally, when the bit weight reaches a predetermined limit or excessive amount, there is no further conduction of drilling fluid 260 through the drill pipe 196 to the flexible drill shaft. Interruption of this drilling fluid flow due to reaction from bit weight provides the actual limiter indication at the rig floor.

In FIG. 11, a cylindrical housing 262, e.g. a section of suitable size casing, is formed to include an annular end cap 264 at the lower end and an end cap 266 at the upper end. Lower end cap 264 defines an axial bore and receives the lower end of a cylindrical conduit 268 in secure engagement to extend axially upward within housing 262 for a predetermined distance. The upper annular cap 266 also defines a central bore 270 defining a plurality of circumferentially arrayed teeth 272 for retention within respective longitudinal grooves 274 formed along the outer surface of the rotary collar 192, a spline-type sliding engagement. The rotary collar 192 extends concentrically downward within housing 262 for traverse in sliding engagement through the upper end of cylindrical conduit 268. A plurality, e.g. a quadrature array, of centering spacers 276 are secured as by welding about the lower portion of upper drive shaft 192 in sliding engagement with the inner wall of housing 262.

A support block 278 having passages 280 is secured as by welding across the inner throat of rotary drive shaft 192. Block 278 is open to fluid flow by a predominant amount to enable essentially unimpeded downward flow. The block 278 is also secured to support axially a mandrel 282 that includes three stages of cylindrical block 284, 286 and 288 of successive smaller diameter. Thus, when bit weight increases, the rotary collar 192 is forced downward within cylindrical housing 262 to insert the cylindrical blocks downward within conduit 268. As this happens, the cylinders block downward fluid flow first partially, then to a greater degree, and finally completely as cylinder block 284 enters the upper mouth of fluid conduit 268. This indication is reflected immediately at the drilling platform and the rig works can be controlled to alleviate the overbearing situation. A plurality of upper and lower ports 290 are provided to alleviate any pressure build-up that might develop from surrounding mud or debris. The rotary drive shaft 192 is free for reciprocal but non-rotative movement within housing 262. When drilling proceeds at a normal rate, downward fluid flow is essentially unimpeded and torque from drive shaft 192 is transmitted through housing 194 to the drill pipe 196.

Figure 12:
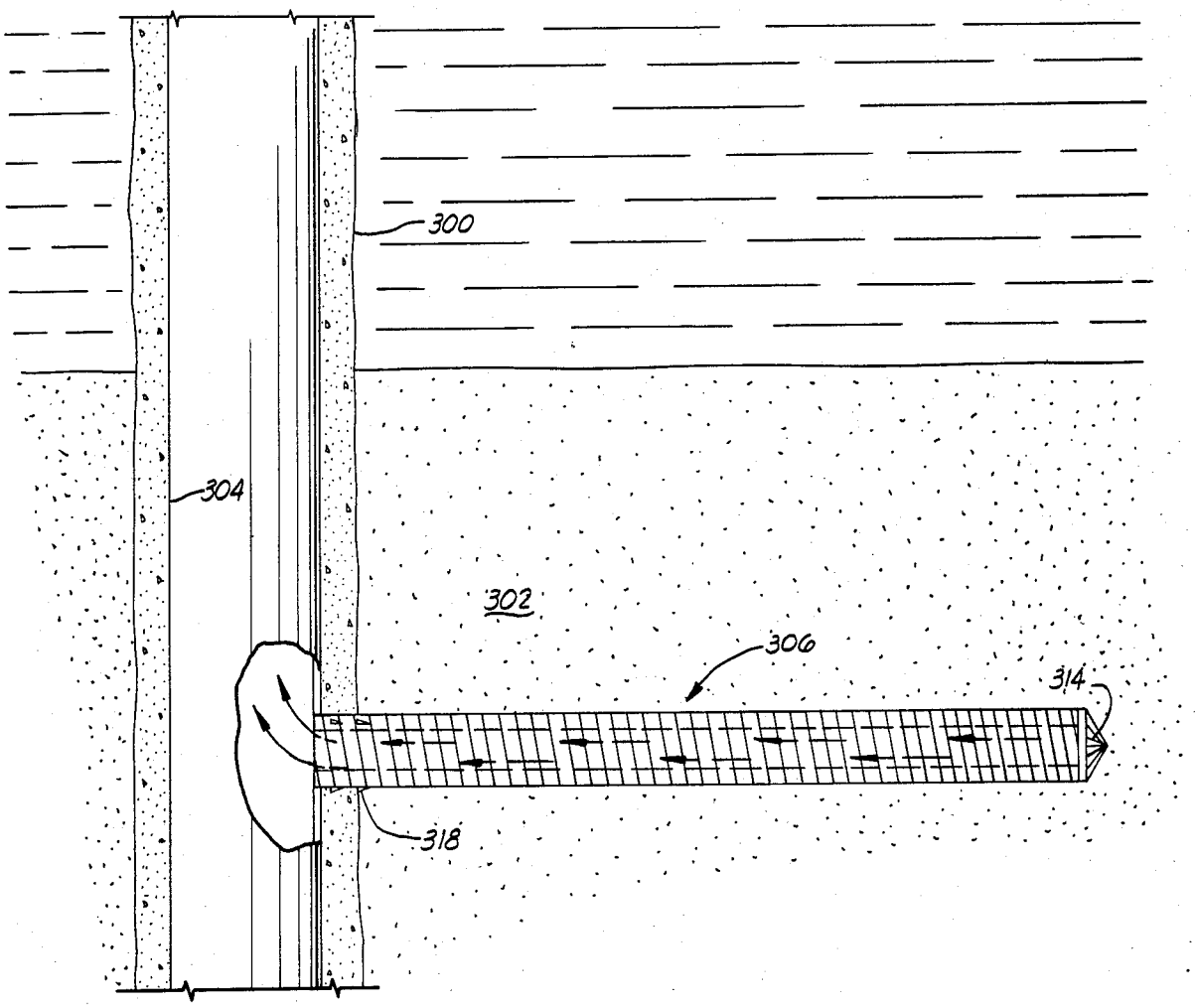
FIG. 12 is an idealized illustration of a flexible drilling production shaft as utilized in a producing formation.
Figure 13:
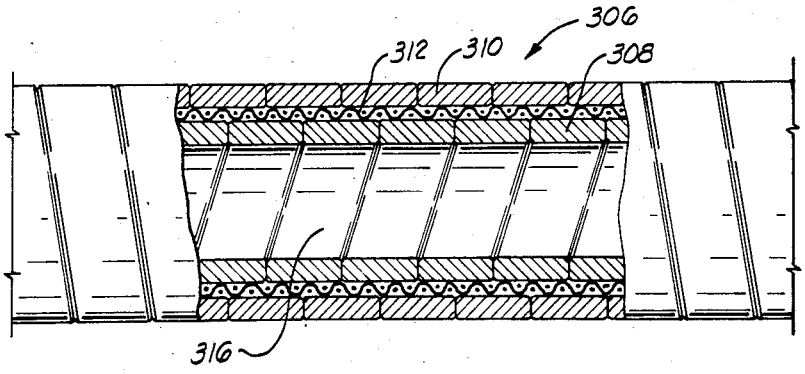
FIG. 13 is an enlarged view in section of the production shaft of FIG. 12.

Finally, FIGS. 12 and 13 illustrate an alternative operation that is particularly useful for use in those high production formations that are able to maintain free flow of hydrocarbons at high rate from inherent reservoir pressure. The high volume, freely flowing oil production situations can conceivably show a direct increase in oil production proportionate to the lengths and numbers of radial projections. Thus, in FIG. 12, an earth borehole 300 is drilled through a producing formation 302 and provided with a casing 304 in conventional manner. In this case, it is intended to locate a drilling assembly such as that of FIG. 9 in casing 304 and set the drill hole 212 position adjacent the porous formation 302, a known hydrocarbon reservoir. The actual flexible cable used in this case also includes foraminous cloth or screen material (FIG. 13) filtration of the hydrocarbon product as the flexible shaft is allowed to remain in situ and act as a production conduit. The flexible shaft 306, e.g. a dual coil shaft having inner coil 308 and outer coil 310, also includes one or more foraminous barriers 312.

In operation, drill bit 314 is used to penetrate the formation 302 to a preselected distance, and then the flexible shaft 306 is released to remain in place as hydrocarbon product flows through the foraminous barrier 312 and drive coils to the axial passage 316 and into casing 304 for production recovery. Conventional methods are used to penetrate the casing and any cement, and a conventional form of ball release or casing latch 318 may be utilized to secure the flexible shaft 306 when as the remainder of the rotary drilling assembly is removed from the hole. Alternatively, the conventional drilling shaft may be used with subsequent substitution of a lighter, filtered version of flexible coil for production purposes.

The foregoing discloses a novel method and apparatus which has the effect of greatly increasing borehole drainage area or interface thereby to substantially increase the flow rate and cumulative production of a well. In addition, tapping of the well production volume in this manner can well increase the overall life of a well. The present method of drilling generally lateral interfacing into hydrocarbon bearing formations, and further extending the interface area with a plurality of radial holes, will tend to increase production by a great amount to enable controlled production well past the depletion points as would have been encountered using prior methods.

The method and apparatus of the present invention will find utilization in any of new well completions, re-entry or alteration of wells with gravel packing. Production should be increased on new wells while better management of pressure is maintained thereby to give the well longer life and more usable oil or gas output. Wells that have previously lost their production capability but have maintained suitable pressure can still be re-entered, and in many instances the production can be greatly enhanced. The present method and apparatus should also find diverse applications in the various angled or directional drilling operations, as well as in the mining industry and irrigation water development.

Changes may be made in the combination and arrangement of elements and/or steps as heretofore set forth in the specification and shown in the drawings; it being understood that changes may be made in the embodiments disclosed without departing from the spirit and scope of the invention as defined in the following claims.

What is claimed is:

1. A bendable drill shaft for boring earth material comprising:

drive coupling means formed about a longitudinal axis and adapted for affixure to a rotational drive source;

an inner coil shaft formed of flat metal stock having a lesser thickness dimension than width secured to said drive coupling means in equi-spaced relationship to said longitudinal axis;

an outer coil shaft formed of flat stock having a lesser thickness dimension than width and being oppositely coiled from said inner coil shaft, secured to said drive coupling means concentric to said inner coil shaft; and drill bit means secured to said inner coil shaft to maintain adjacent coil edges flush, while being secured to said outer coil shaft to maintain the adjacent coil edges flush and to maintain the adjacent inner and outer coil surface flush.

2. Apparatus as set forth in claim 1 which further includes: at least one additional coil shaft formed of flat metal stock and secured to said drive coupling means and drill bit with adjacent coil edges flush and in juxtaposed contact with the proximate coil shaft.

3. Apparatus as set forth in claim 1 which further includes:

an axial bore formed through said coupling means; a bore formed from an axial point through said drill bit; and flexible hose coupling between said coupling means axial bore and said axial point of the drill bit.

4. Apparatus as set forth in claim 1 which is further characterized in that:

said inner and outer coil shafts are secured to the respective drive coupling means and drill bit means by radially directed pins.

5. Apparatus as set forth in claim 4 which is further characterized in that:

a greater number of securing pins are employed at the drive coupling means than at the drill bit means to influence the break point in the event of excessive shear stress.

6. Apparatus as set forth in claim 1 which is further characterized in that:

the flat metal stock for each of said coil shafts is formed in rectangular cross-section with a minimal break across each edge corner.

7. Apparatus as set forth in claim 6 wherein:

the flat metal stock may have a ratio of width to thickness of approximately 0.375 to 0.125 with corners minimally rounded.

8. Apparatus as set forth in claim 1 wherein said drill bit means comprises:

spindle means of cylindrical formation having inner and outer ends with threaded bore formed axially at the inner end and threaded circumfery at the outer end while receiving affixure of the inner and outer coils around the inner end; and bit means including threaded axial bore for mating engagement with said threaded circumfery for positioning adjacent said inner and outer coils.

9. Apparatus as set forth in claim 8 which further includes:

flexible tubing means threadedly engaged to communicate between said spindle means, threaded bore and said drive coupling means.

10. Apparatus as set forth in claim 9 wherein said flexible tubing means comprises:

a flexible tube having first and second ends that resists twisting movement;

a threaded coupling secured on the first end for engagement in said spindle means;

a threaded coupling on the second end;

tube means threadedly engaged on said second end and extending axially through said drive coupling means; and nut means securing said tube means while tensioning said flexible tube.

11. Apparatus as set forth in claim 1 which further includes:

two additional coil shafts formed of flat metal stock and having a lesser thickness dimension than width secured in opposite wound and flush disposition between said inner and outer coil shafts, each being secured between said drive coupling means and drill bit means.

12. Apparatus as set forth in claim 11 wherein said drill bit means comprises:

spindle means of cylindrical formation having inner and outer ends with threaded bore formed axially at the inner end and threaded circumfery at the outer end while receiving affixure of the inner and outer coils around the inner end; and bit means including threaded axial bore for mating engagement with said threaded circumfery for positioning adjacent said inner and outer coils.

13. Apparatus as set forth in claim 12 which further includes:

a flexible tube having first and second ends that resists twisting movement;

a threaded coupling secured on the first end for engagement in said spindle means;

a threaded coupling on the second end;

tube means threadedly engaged on said second end and extending axially through said drive coupling means; and nut means securing said tube means while tensioning said flexible tube.

14. Apparatus as set forth in claim 1 which further includes:

foraminous barrier means coextensive with and extending between said inner and outer coil shafts;

whereby said drill shaft can be placed into a preselected adjacent formation and left to provide a production recovery conduit.

15. Apparatus for radially drilling from an earth borehole into an adjacent formation comprising:

rotating pipe means providing rotational force in said borehole;

a drill guide housing of elongated form having upper and lower portions;

guide means extending along the lower portion of the drill guide housing and through an angular bend for exit at a selected angle in a radial direction relative to said borehole;

a rotary shaft receiving said rotational force and moveably extending through the upper portion of said housing;

a bendable drill shaft consisting of oppositely wound concentrically contacting plural coil shafts having first and second ends with bit connected on the second end and said rotary shaft connected to the first end;

whereby said rotary shaft may be moved downward to extend said bendable drill shaft through said guide means to force said bendable drill shaft and bit for movement at a selected angle into said adjacent formation.

16. Apparatus as set forth in claim 15 wherein said rotating pipe means comprises:

a rotary drill string including downward traveling drilling fluid under pressure;

weight limiter means interconnected in the drill string and effective to provide a drilling fluid pressure indication in proportion to the actual weight on the bit.

17. Apparatus as set forth in claim 16 wherein said weight limiter means comprises:

drive shaft means connected integral with the drill string and having a coaxial mandrel secured therein while allowing down flow of drilling fluid therearound, said drive shaft means having a plurality of parallel grooves extending in spaced disposition therearound;

cylinder means disposed concentrically over said drive shaft means and including plural teeth slidably engaged in respective grooves to maintain the cylinder means rotationally rigid relative to said drive shaft means, said cylinder means being axially secured to said drill string extending below;

inner cylinder means secured axially within said cylinder means to extend upwardly and concentrically within said drive shaft means adjacent mandrel and conducting downward fluid flow;

whereby excessive downward force on the bit moves the inner cylinder upward over said mandrel to block downward fluid flow and enable characteristic indication.

18. Apparatus as set forth in claim 16 which further includes:

a locking means retained in the drill guide housing upper means to maintain the rotating pipe means and rotary shaft in longitudinally secure position to the housing until a predetermined number of rotations of the rotary shaft has occurred relative to the housing.

19. Apparatus as set forth in claim 15 which further includes:

a locking means retained in the drill guide housing upper means to maintain the rotating pipe means and rotary shaft in longitudinally secure position to the housing until a predetermined number of rotations of the rotary shaft has occurred relative to the housing.

20. Apparatus as set forth in claim 15 wherein:

said drill guide housing lower portion includes an appreciable volume below said angular bend and exit for receiving and retaining drilled cuttings.

21. Apparatus as set forth in claim 15 which further includes:

packer means connected to said drill guide housing and actuatable to secure the drill guide housing at selected position in the borehole.

* * * * *